US008108973B2

(12) United States Patent
Chen

(10) Patent No.: US 8,108,973 B2
(45) Date of Patent: Feb. 7, 2012

(54) SIDE BUCKLE OF SWIMMING GOGGLES

(75) Inventor: Cheng-Yo Chen, Taipei Hsien (TW)

(73) Assignee: First Rank Co., Ltd., Taipei Hsien (TW)

( * ) Notice: Subject to any disclaimer, the term of this patent is extended or adjusted under 35 U.S.C. 154(b) by 658 days.

(21) Appl. No.: 12/240,054

(22) Filed: Sep. 29, 2008

(65) Prior Publication Data

US 2010/0077539 A1 Apr. 1, 2010

(51) Int. Cl.
*A44B 11/12* (2006.01)
*A44B 11/00* (2006.01)

(52) U.S. Cl. ..... 24/170; 24/163 R; 24/191; 24/193; 24/198; 24/200

(58) Field of Classification Search ..... 24/17 AP, 24/115 R, 129 R, 129 D, 132 R, 134 R, 134 L, 24/163 R, 170, 186, 188, 191–193, 196, 198–200, 24/615, 633; 2/426, 909
See application file for complete search history.

(56) References Cited

U.S. PATENT DOCUMENTS 3,043,902 A * 7/1962 Klein ..... 174/146
3,328,856 A * 7/1967 Jonas ..... 24/191
5,467,508 A * 11/1995 Feng ..... 24/68 SK
5,918,351 A * 7/1999 Chou ..... 24/265 BC
6,691,378 B1 * 2/2004 Chou ..... 24/170
6,961,965 B2 * 11/2005 Chiang ..... 2/445
7,143,484 B2 * 12/2006 Lee ..... 24/199
7,296,306 B2 * 11/2007 Chou ..... 2/448
7,340,804 B2 * 3/2008 Saderholm et al. ..... 24/265 BC
7,640,633 B2 * 1/2010 Chou ..... 24/68 E
7,921,523 B2 * 4/2011 Chou ..... 24/170
2006/0010585 A1 * 1/2006 Chiang ..... 2/426
2006/0015990 A1 * 1/2006 Chiang ..... 2/426
2006/0026804 A1 * 2/2006 Lee ..... 24/198
2006/0032027 A1 * 2/2006 Shiue ..... 24/191
2006/0059607 A1 * 3/2006 Chiang ..... 2/428
2007/0044285 A1 * 3/2007 Kawamura et al. ..... 24/633
2008/0072366 A1 * 3/2008 Fukasawa ..... 2/445
2008/0209702 A1 * 9/2008 Van Dine et al. ..... 24/68 SK
2008/0289160 A1 * 11/2008 Chou ..... 24/68 R

* cited by examiner

*Primary Examiner* — Robert J Sandy
*Assistant Examiner* — Tyler Johnson
(74) *Attorney, Agent, or Firm* — Rabin & Berdo, P.C.

(57) ABSTRACT

A side buckle of swimming goggles is approximately formed into a strip shape. The side buckle has a retaining clip and a retaining groove respectively at two ends thereof. The retaining clip has two shaft rods and a step-shaped urging portion. The retaining groove has two shaft holes and a belt hole. A connecting portion is formed between the retaining clip and the retaining groove. The retaining clip and the retaining groove may be locked to each other after the connecting portion is bent. Thereby, the side buckle of swimming goggles is fitted at side edges of a pair of swimming goggles and connected to a belt. The connecting portion is pressed to trigger the operation of the retaining clip to loosen or fasten the belt, so as to quickly adjust a length of the belt.

3 Claims, 5 Drawing Sheets

SIDE BUCKLE OF SWIMMING GOGGLES

BACKGROUND OF THE INVENTION

1. Field of Invention

The present invention relates to a side buckle structure installed at two side edges of a pair of swimming goggles for a belt to pass there through, and more particularly to a side buckle of swimming goggles integrally formed into a strip shape, a retaining clip and a retaining groove of which may be locked into a whole after being bent.

2. Related Art

Recently, people have gradually paid attention to leisure sports. As a leisure sport capable of enhancing vital capacity and exercising muscles of the whole body, swimming is of great benefit to the physical health care. What's more, the burden on the body is greatly reduced due to the buoyancy effect of water on the body daring swimming. Therefore, swimming is also often used to help recovery from diseases.

Referring to FIG. 1, a pair of common swimming goggles 1 is provided with two through holes 11 at two sides thereof, for two ends of a belt 2 to pass through. An end edge of the belt 2 is fitted in a retainer 3. The retainer 3 is roughly in a "⊥"shape and bent inward at two sides thereof respectively to form two notched portions 31. Therefore, the retainer 3 has two spaces for the belt 2 to pass through, such that the belt 2 may pass through the retainer 3 in an interlacing and overlapping manner. With a friction between overlapped surfaces of the belt 2, a relative position and length of the belt 2 may be fixed. Moreover, the length of the belt 2 is adjustable to increase the comfort of wearing the swimming goggles 1.

However, when the length of the belt 2 is adjusted, the user must take off the swimming goggles 1 completely, so as to sequentially adjust the lengths of the belt 2 at two sides of the retainer 3 by both hands and gradually adjust the length of the belt 2 by loosening and tensioning it. The operation of the adjustment is quite inconvenient. Moreover, since the adjustment is performed visually, the user cannot adjust the belt 2 to the proper length at a time. Instead, the user must put on and take off the swimming goggles 1 repeatedly, which increases the difficulty in the adjustment. Therefore, the structure needs to be improved.

SUMMARY OF THE INVENTION

The present invention is directed to a side buckle of swimming goggles with the most energy-saving mold structure and having advantages of product universality, easy assembly, and the like, in which a length of a belt may be conveniently adjusted, so as to solve the disadvantages in the conventional design and increase the convenience in usage.

In order to achieve the above objective, the side buckle of swimming goggles in the present invention is integrally formed into a strip shape, and has a retaining clip and a retaining groove respectively at two ends thereof. The retaining clip has a shaft rod at each of two sides thereof and an urging portion on an inner surface adjacent to an end edge of the retaining clip. The urging portion is protruded from the surface in a continuous step shape. The retaining groove is provided at each of two sides thereof with a folded plate having a shaft hole, and has a belt hole adjacent to an end edge of the retaining grove. A connecting portion is formed between the retaining clip and the retaining groove, and may dispose the retaining clip in the retaining groove after being bent. Furthermore, the connecting portion has an elliptical-shaped pressing portion.

To sum up, when the side buckle of swimming goggles is assembled at a pair of swimming goggles, the retaining clip passes through a through hole at one side edge of the swimming goggles and is locked in the retaining groove after the connecting portion is bent. The belt for wearing passes through the belt hole of the retaining groove, and is fixed by pushing the urging portion of the retaining clip to be fastened in one of continuous retaining portions on the belt with a restoring elasticity of the connecting portion. The side buckle of swimming goggles is assembled at the other side of the swimming goggles in the same manner, which is also quite simple. When adjusting the belt, the user depresses the pressing portion on the connecting portion, and then the urging portion may be rotated in an opposite direction with a shaft joint as a pivot, so as to be separated from the retaining portion of the belt to assume a movable state. The user can adjust the length of the belt by a single hand without taking off the swimming goggles, and the adjustment is quite easy and convenient, such that the convenience in the usage is increased.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to make the content of the present invention comprehensible, the following illustration accompanied with figures is provided for the examiner to review.

Figure 1:
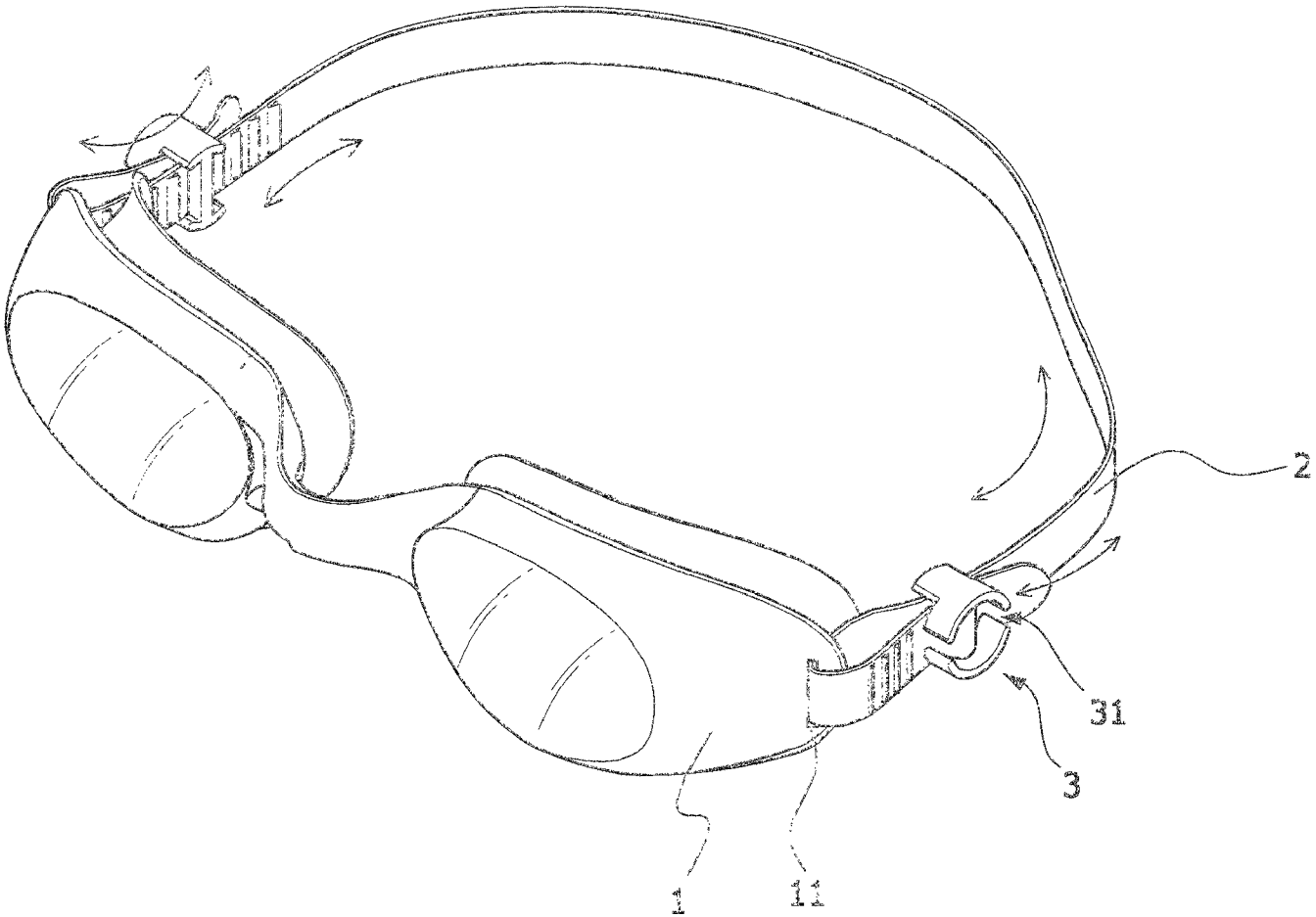
Fig.1(PRIOR ART)
FIG. 1 is a schematic assembled view of a pair of swimming goggles and a belt in the conventional art.
Figure 2:
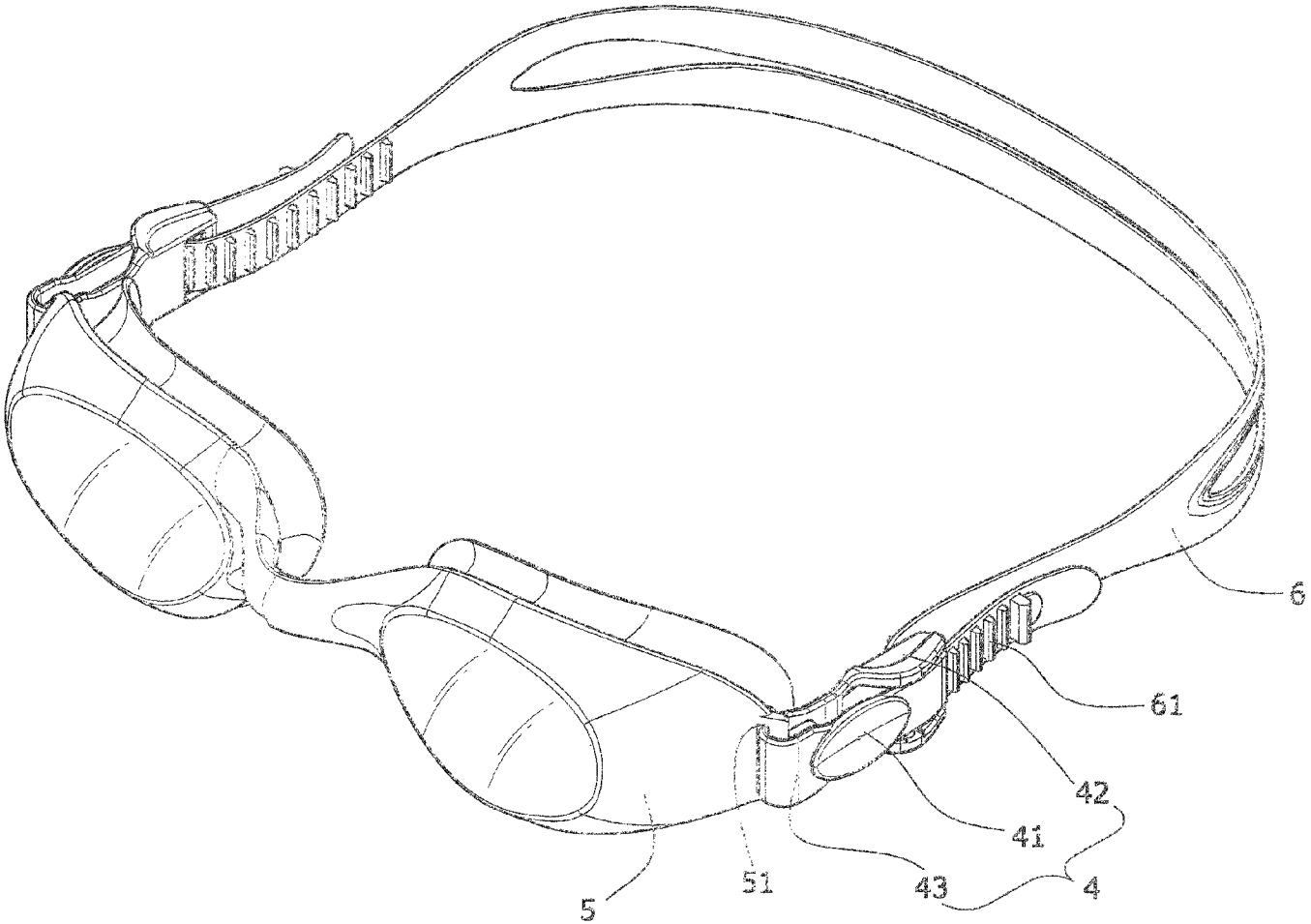
FIG. 2 is a schematic view illustrating an installation of a side buckle of swimming goggles according to a preferred embodiment of the present invention to a pair of swimming goggles and a belt.
Figure 3:
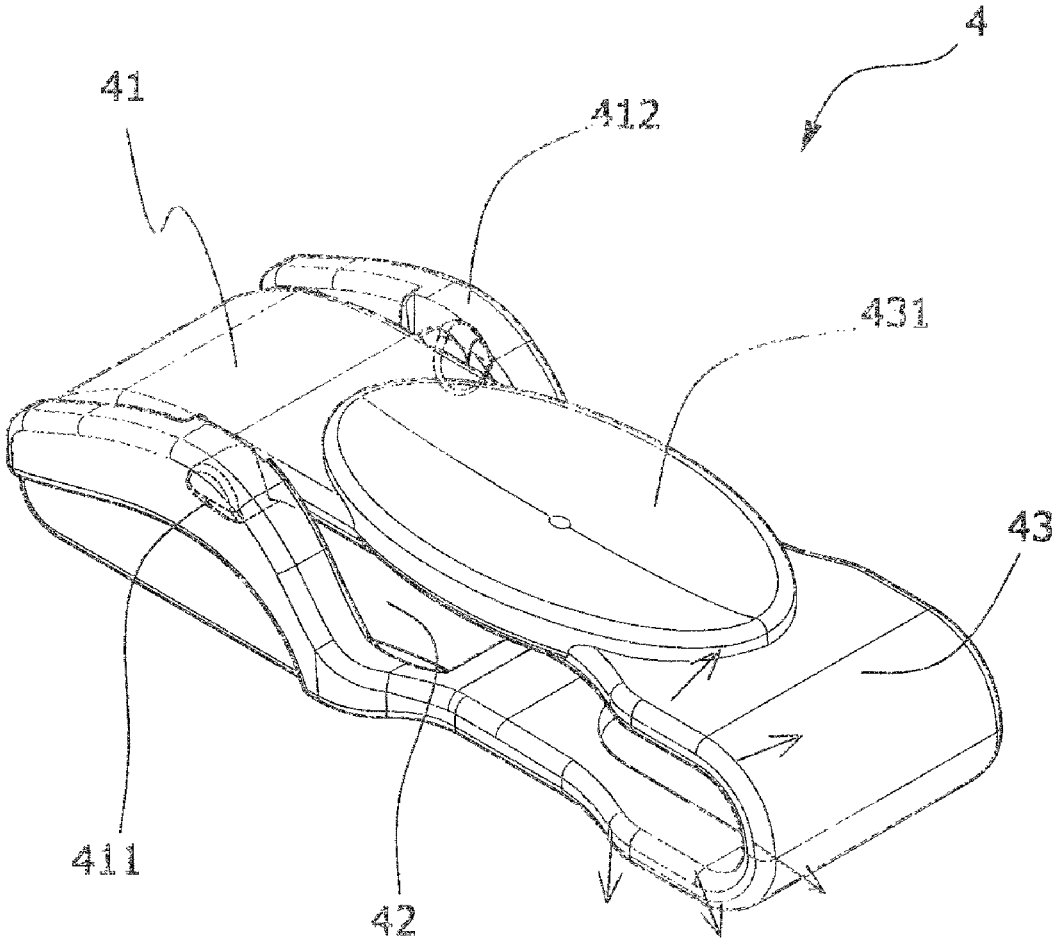
FIG. 3 is a three-dimensional view of the folded side buckle of swimming goggles according to the preferred embodiment of the present invention.
Figure 4:
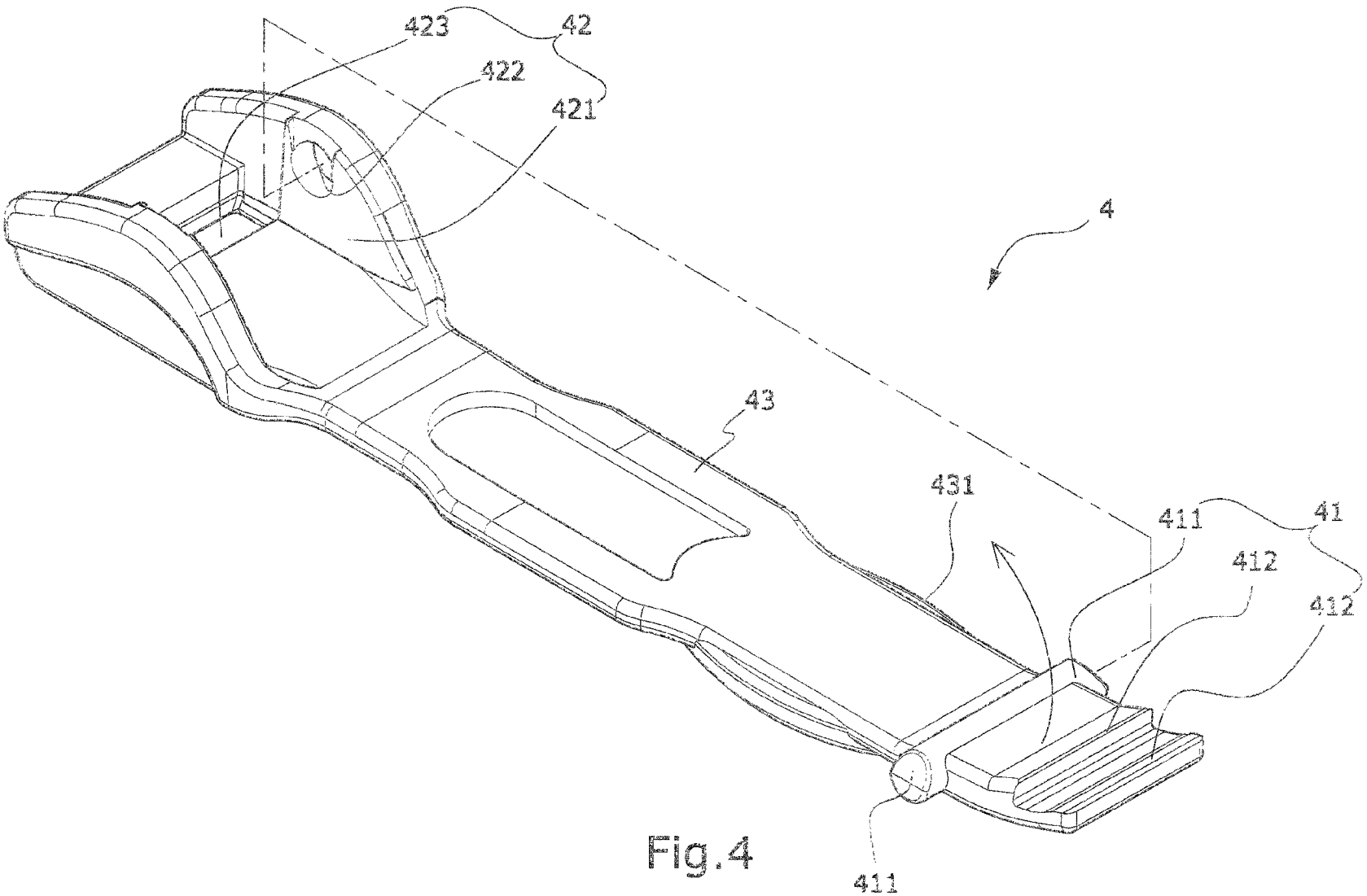
FIG. 4 is a three-dimensional view of the unfolded side buckle of swimming goggles according to the preferred embodiment of the present invention.

Referring to FIGS. 2 to 4, a side buckle 4 of swimming goggles in the present invention is approximately formed into a strip shape. The side buckle has a retaining clip 41 and a retaining groove 42 respectively at two ends thereof, with a connecting portion 43 formed there-between. One end of the retaining clip 41 passes into a through hole 51 disposed at a side edge of a pair of swimming goggles 5. The retaining clip 41 has a shaft rod 411 protruded outward at each of two sides thereof and at least one urging portion 412 in a continuous step shape on an inner surface adjacent to an end edge thereof. The urging portion 412 is planar on one surface, and is used to fasten continuous retaining portions 61 on a belt 6 which have a proper spacing there-between. The retaining groove 42 is provided at each of two sides thereof with an upright folded plate 421 having a shall hole 422, and has a belt hole 423 at an end edge adjacent to the strip for the belt 6 to pass through.

Furthermore, the connecting portion 43 is made of a flexible plastic material and may be bent into a ring shape. The connecting portion 43 has a pressing portion 431 adjacent to the retaining clip 41. The pressing portion 431 is in an elliptical shape to increase an area for the user to press, so as to facilitate the pressing. Thereby, when the retaining clip 41 is bent along the connecting portion 43, the retaining clip 41 may be aligned with the retaining groove 42, and the shaft rods 411 of the retaining clip 41 may be locked in the shaft holes 422 of the retaining groove 42. Then, the pressing portion 431 may be operated with this shaft joint as a pivot, such that the urging portion 412 of the retaining clip 41 is rotated in both directions.

Thereby, after being assembled with the swimming goggles 5 and the belt 6, the side buckle 4 of swimming goggles in the present invention is formed into a coil shape and has elasticity to be used to adjust the belt 6, which is convenient for the user to wear in usage, and is quite simple and convenient to assemble.

Figure 5:
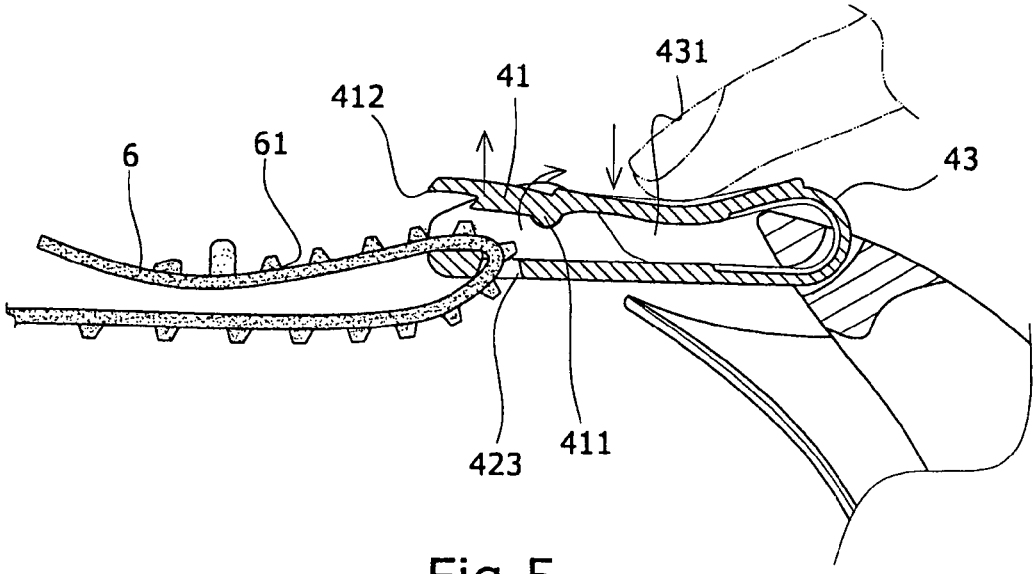
FIG. 5 is a first schematic view illustrating an operation of adjusting the belt in the preferred embodiment of the present invention.
Figure 6:
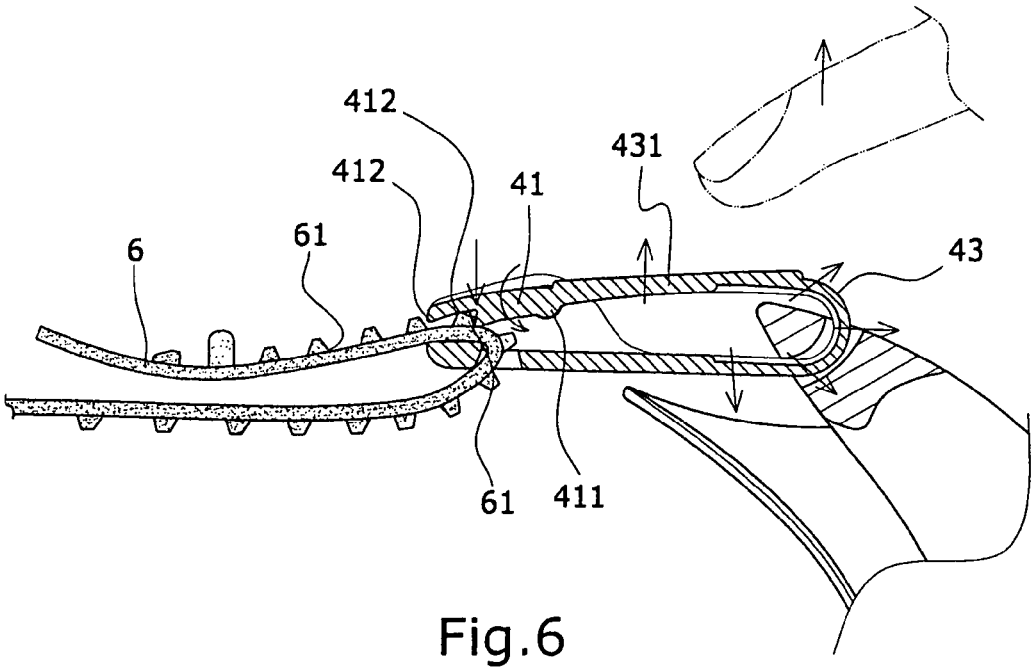
FIG. 6 is a second schematic view illustrating the operation of adjusting the belt in the preferred embodiment of the present invention.

Referring to FIGS. 5 and 6, the connecting portion 43 in the present invention may be expanded outward and formed into a ring shape by a restoring elasticity of itself after being bent, and the retaining clip 41 may be rotated with the shaft joint of the shaft rod 411 as a pivot to push the urging portion 412 to press downward, so as to fasten one of the retaining portions 61 of the belt 6. When intended to perform an adjustment, the user only needs to depress the pressing portion 431 of the connecting portion 43 by a single hand, and drive the urging portion 412 of the retaining clip 41 to rotate in an opposite direction (the urging portion 412 is moved upward) with the shaft joint as a pivot, such that the urging portion 412 is separated from the retaining portion 61 of the belt 6, and then the belt 6 is in a movable state and a length thereof can be movably adjusted. After the adjustment is finished, the pressing portion 431 only needs to be released and is restored to its original state by the restoring force of the connecting portion 43 itself. The pressing portion 431 is moved upward to drive the urging portion 412 at the other side of the shaft joint to move downward to be refastened in another retaining portion 61 of the belt, so as to complete the operation of adjusting the length. The whole adjustment process may be accomplished by the user with a single hand without taking off the swimming goggles, and the adjustment is quite easy and convenient, such that the convenience in the usage of the present invention is increased.

As described above, the side buckle of swimming goggles in the present invention (referred to as the present application hereinafter) has the following advantages.

1. Referring to FIGS. 2 to 4, the side buckle 4 of swimming goggles in the present application is integrally formed into a strip shape, and has a retaining clip 41 and a retaining groove 42 at two ends thereof with a connecting portion 43 formed there-between, the connecting portion 43 may be bent to lock the retaining clip 41 and the retaining groove 42 to each other, such that the side buckle 4 of swimming goggles is assembled at side edges of the swimming goggles and connected with the belt into a whole, and thus the assembly thereof is quite simple and convenient.

2. Moreover, since the connecting portion 43 in the present application has a restoring force, it is expanded outward and formed into a ring shape after being bent, such that the retaining clip 41 generates a force to fasten the belt 6 with the shaft joint as a pivot. When the pressing portion 431 is depressed, the belt 6 is loosened to be adjusted in length, and the pressing portion 431 is released again to refasten the belt 6, such that the adjustment may be accomplished by the user with a single hand and is quite easy and convenient.

The above description is merely a preferred embodiment of the present invention, but not intends to limit the implementing scope of the present invention. Other contents such as the change of the elastic material used by the connecting portion also fall within the scope of the present application. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

In view of the above, the side buckle of swimming goggles in the present invention meets the patent requirements for the inventive step and industrial applicability. Therefore, the applicant files an application for a utility model patent to the patent office according to the provisions of the patent law.

What is claimed is:

1. A side buckle for swimming goggles that receives a belt winding therethrough, the belt having a plurality of retaining portions on a surface, the side buckle being made of a flexible material and having a curved shape, comprising:

a retaining clip formed in an end of the side buckle, the retaining clip having at least one urging portion to engage with one of the retaining portions of the belt, and a shaft rod that extends from a side of the retaining clip to an opposite side of the retaining clip;

a retaining groove formed in another end of the side buckle and having a belt hole, and at each of two opposite sides of the retaining groove having an upright plate with a shaft hole; and a connecting portion formed between the retaining clip and the retaining groove, wherein when the connecting portion is bent the shaft rod is inserted into the shaft holes and serves as a shaft joint, and a buckle recess is formed between the retaining clip and the retaining groove, the belt passing from the belt hole through the buckle recess, wherein the connecting portion has a pressing portion, and when the pressing portion is pressed in a first direction, the shaft joint serves as a pivot whereby the retaining clip moves in a second direction opposite the first direction, releasing the urging portion from the retaining portion.

2. The side buckle for swimming goggles according to claim 1, wherein a portion of the connecting portion passes into a through hole of a pair of swimming goggles.

3. The side buckle for swimming goggles according to claim 1, wherein the belt enters into the side buckle through the belt hole, and exits the side buckle through the buckle recess.

* * * * *